US007804388B2

(12) United States Patent
Luo et al.

(10) Patent No.: US 7,804,388 B2
(45) Date of Patent: Sep. 28, 2010

(54) TRANSFORMER

(75) Inventors: Jebby Luo, Dong-Guan (CN); Ching Sung Kung, Dong-Guan (CN)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/349,655

(22) Filed: Jan. 7, 2009

(65) Prior Publication Data

US 2010/0117778 A1 May 13, 2010

(30) Foreign Application Priority Data

Nov. 7, 2008 (TW) ..... 97220015 U

(51) Int. Cl.
*H01F 27/30* (2006.01)
*H01F 21/02* (2006.01)
*H01F 27/28* (2006.01)

(52) U.S. Cl. ..... 336/198; 336/145; 336/170; 336/222; 336/232; 336/208

(58) Field of Classification Search ..... None
See application file for complete search history.

(56) References Cited

U.S. PATENT DOCUMENTS 4,352,079 A * 9/1982 Mueller et al. ..... 336/65
5,008,643 A * 4/1991 Heritier-Best ..... 336/96
6,339,320 B1 * 1/2002 Spremo et al. ..... 323/355
6,545,415 B1 * 4/2003 Ward ..... 315/56
6,900,717 B2 * 5/2005 Timashov et al. ..... 336/208
2002/0153986 A1 * 10/2002 Ushio et al. ..... 336/198
2007/0018769 A1 * 1/2007 Lin ..... 336/208
2007/0115088 A1 * 5/2007 Sugioka ..... 336/232
2008/0284551 A1 * 11/2008 Chen et al. ..... 336/182
2008/0297300 A1 * 12/2008 Ackermann et al. ..... 336/200
2009/0315661 A1 * 12/2009 Teng et al. ..... 336/192

* cited by examiner

*Primary Examiner*—Elvin G Enad
*Assistant Examiner*—Mangtin Lian
(74) *Attorney, Agent, or Firm*—Grossman, Tucker, Perreault & Pfleger, PLLC

(57) ABSTRACT

A transformer is provided. The transformer comprises a coil frame, an input coil and an output coil. The input coil and the output coil are both disposed on the coil frame and interlaced with each other. A second voltage outputted by the output coil is induced by a first voltage inputted into the input coil. The output coil comprises at least one metal strip to enhance the output power. The coil frame is formed with a plurality of coil openings with chamfered angles or rounded angles, so that the bended angle formed by the input coil at the location where the input coil passes each of the coil openings is substantially less than 15 degrees.

12 Claims, 5 Drawing Sheets

TRANSFORMER

This application claims priority to Taiwan Patent Application No. 097220015 filed on Nov. 7, 2008, the disclosure of which is incorporated herein by reference in its entirety.

CROSS-REFERENCES TO RELATED APPLICATIONS

Not applicable.

BACKGROUND OF THE INVENTION

1. Field of the Invention

The present invention relates to a transformer, and more particularly, the present invention relates to a transformer delivering a high output power.

2. Descriptions of the Related Art

Due to the advancement of science and technology, we now have a wide variety of electrical and electronic appliances available for use in our daily life, such as game machines, mobile phones, walkmans and the like. All of these products require a transformer in order to be connected to a power supply or to regulate the internal operating voltage thereof. Hence, transformers have become essential devices for various electrical and electronic appliances.

A conventional practice of increasing the power of a transformer is to increase the output current at the output end to improve the efficiency of the transformer. However, because every kind of wires is subject to a maximum allowable current, the power of a transformer can not be increased without limitation. Otherwise, an overhigh output power would cause damage to the transformer. A solution of the prior art solves this problem by thickening the wire. Unfortunately, this leads to another problem: the thickened wire tends to crack or be scratched during the winding and bending processes due to an overly large bended angle, causing the transformer to fail safety tests. Moreover, because thickening the wire makes it impossible to shrink the volume of the transformer, this is unfavorable in the industry's trend to miniaturize products.

In view of this, it is highly desirable in the art to provide a transformer that delivers a high output power and complies with relevant safety regulations.

SUMMARY OF THE INVENTION

One objective of this invention is to provide a transformer that features a high output power but a small volume.

Another objective of this invention is to provide a transformer adapted to avoid cracking or scratching of the wound wires during the winding and bending processes due to an overly large bended angle.

The transformer disclosed by this invention comprises a coil frame, an input coil and an output coil. The input coil is interlaced with the output coil on the coil frame. The output coil is adapted to output a second voltage that is induced by a first voltage across the input coil. By comprising at least one metallic strip, the output coil is able to withstand a larger current and deliver a higher output power. Furthermore, the at least one metallic strip can be inserted directly into a printed circuit board (PCB) to eliminate the use of output pins, thereby saving costs.

The coil frame of this invention comprises a plurality of partitions, a plurality of first coil grooves and a plurality of coil openings. The partitions define the first coil grooves, while the coil openings are formed on the partitions and connect the first coil grooves. The coil opening of each of the partitions is defined by two sidewalls. The input coil is wound in the first coil grooves through the coil openings. At least one of the sidewalls is a tapered wall with a chamfered angle or a rounded wall with a rounded angle. The bended angle that is formed by the input coil at the location where the input coil passes each of the coil openings is substantially less than 15 degrees, which helps to prevent the wire of the input coil from cracking during the winding process.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 3:
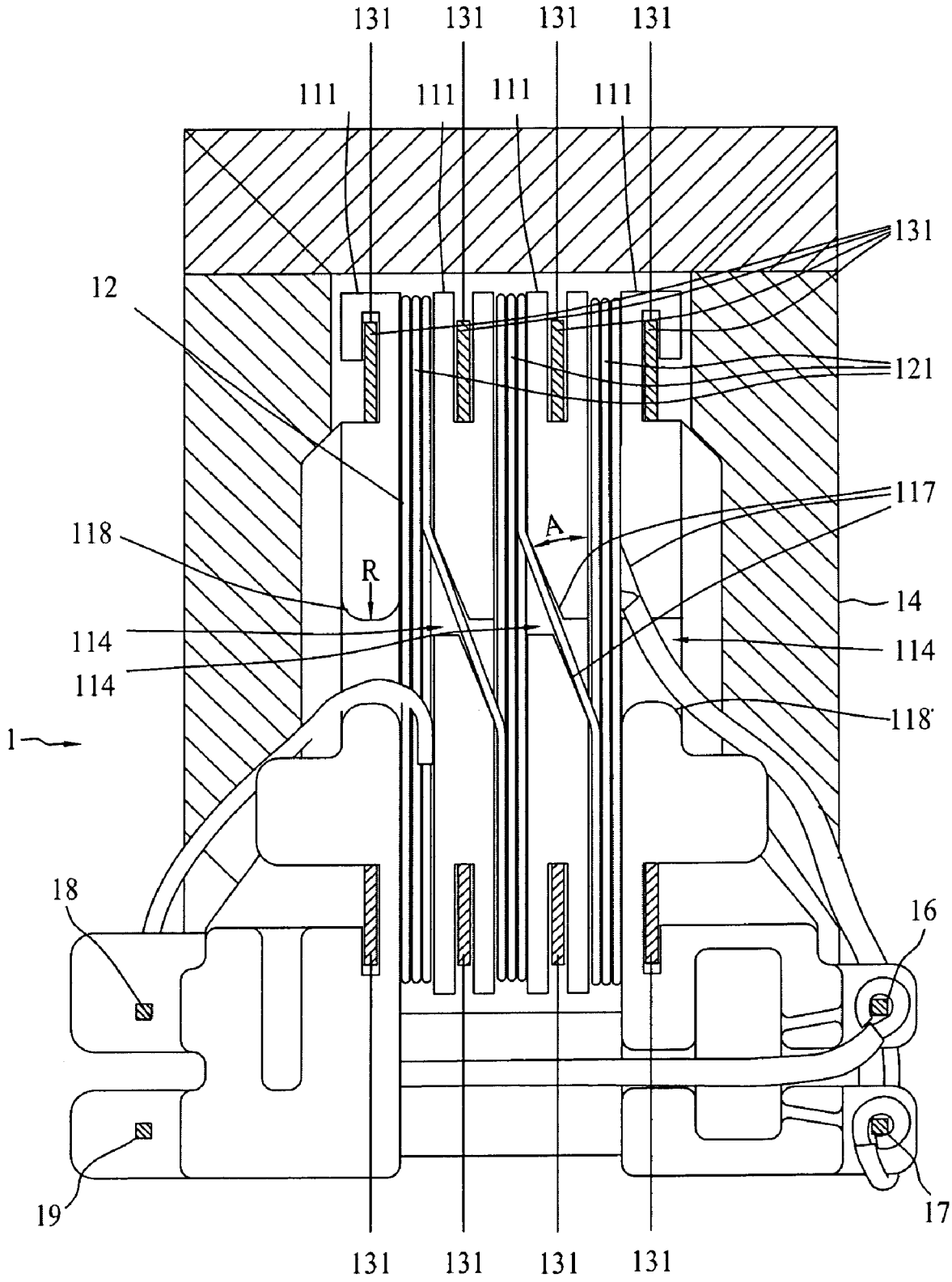
FIG. 3 is a schematic side view of the transformer of this invention.
Figure 4:
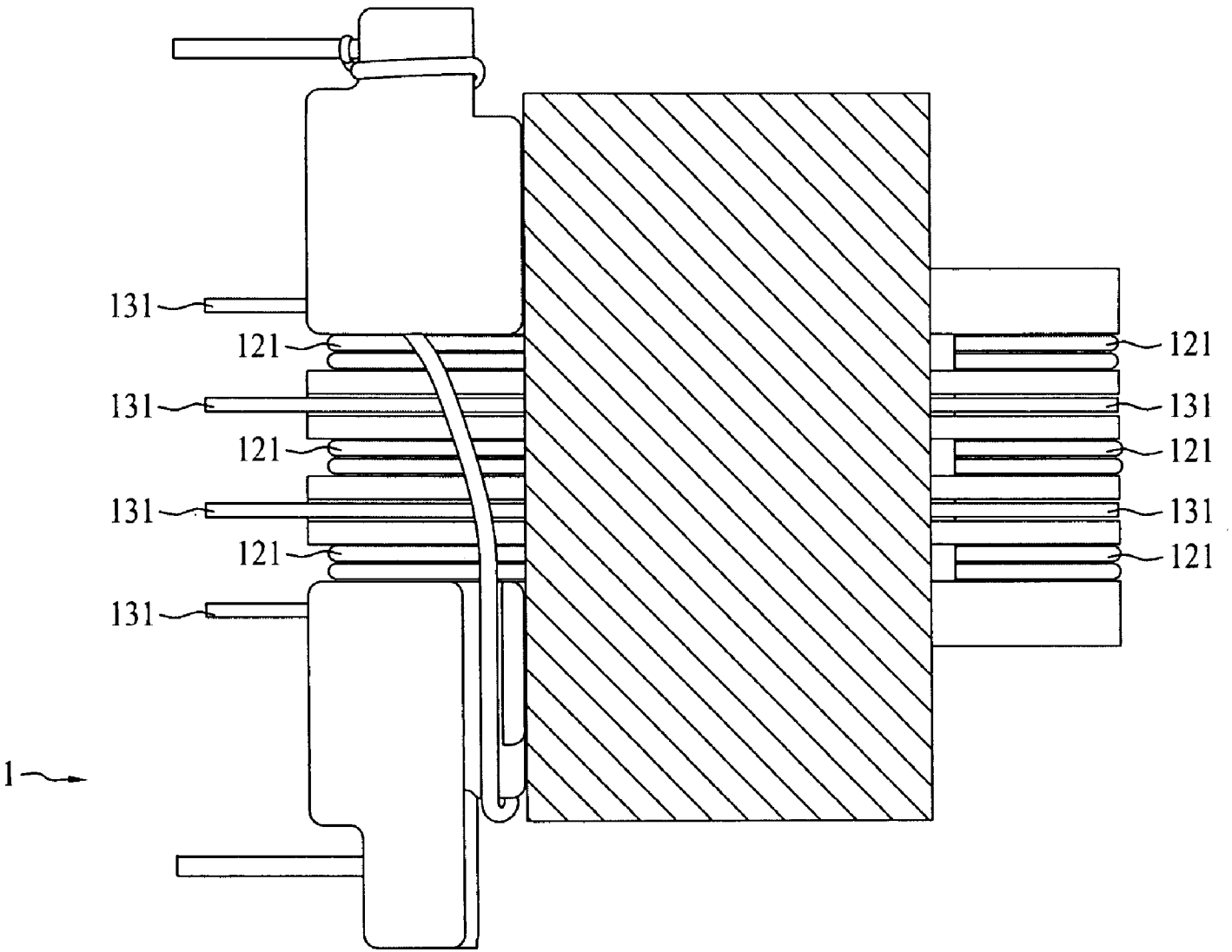
FIG. 4 is a schematic top view of the transformer of this invention.
Figure 5:
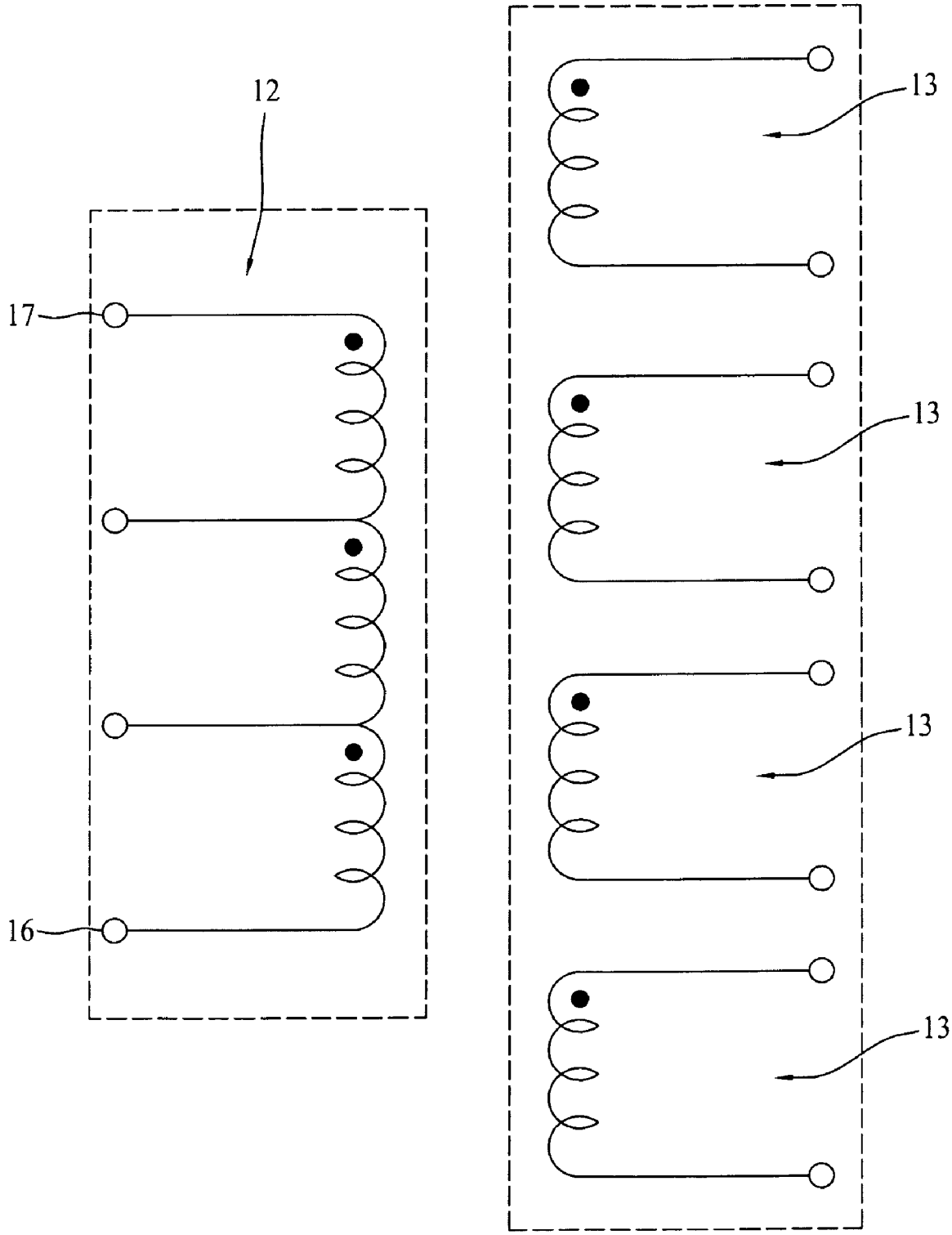
FIG. 5 is a schematic circuit diagram of the transformer of this invention.

As shown in FIGS. 3, 4 and 5, the transformer 1 of this invention comprises a coil frame 11, an input coil 12 and four output coils 13. The input coil 12 and the output coils 13 are disposed on the coil frame 11 and interlaced with each other. Each of the output coils 13 outputs a second voltage induced by a first voltage across the input coil 12. The coil frame 11 comprises four second coil grooves 113, and each of the output coils 13 comprises at least one metallic strip 131 disposed correspondingly in each of the second coil grooves 113 of the coil frame 11 to increase the output power. Preferably, the metallic strip 131 is a copper strip which may further increase the output power. Furthermore, the metallic strip 131 can be inserted directly into the PCB to eliminate the use of output pins.

Figure 1:
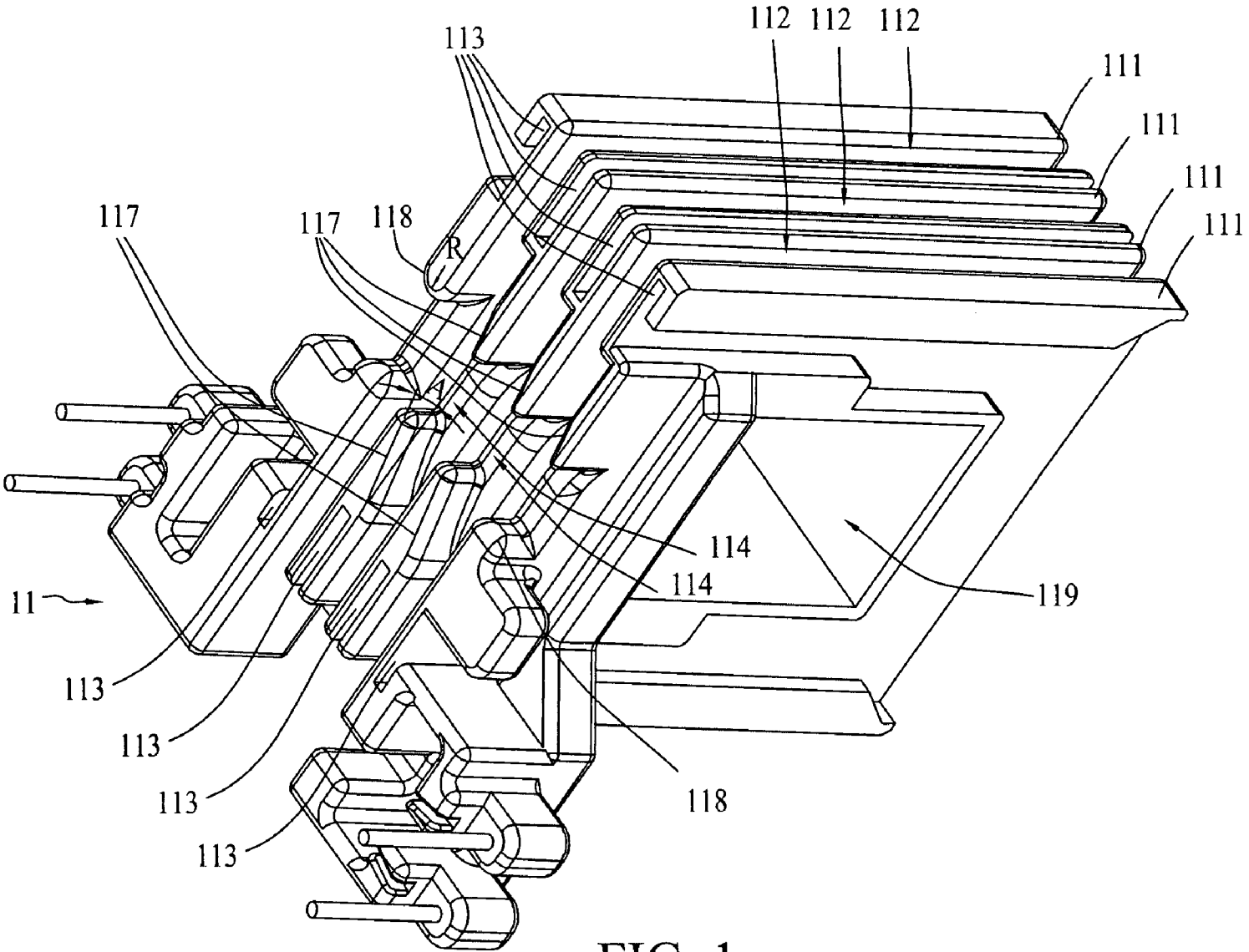
FIG. 1 is a schematic perspective view of the coil frame of this invention.
Figure 2:
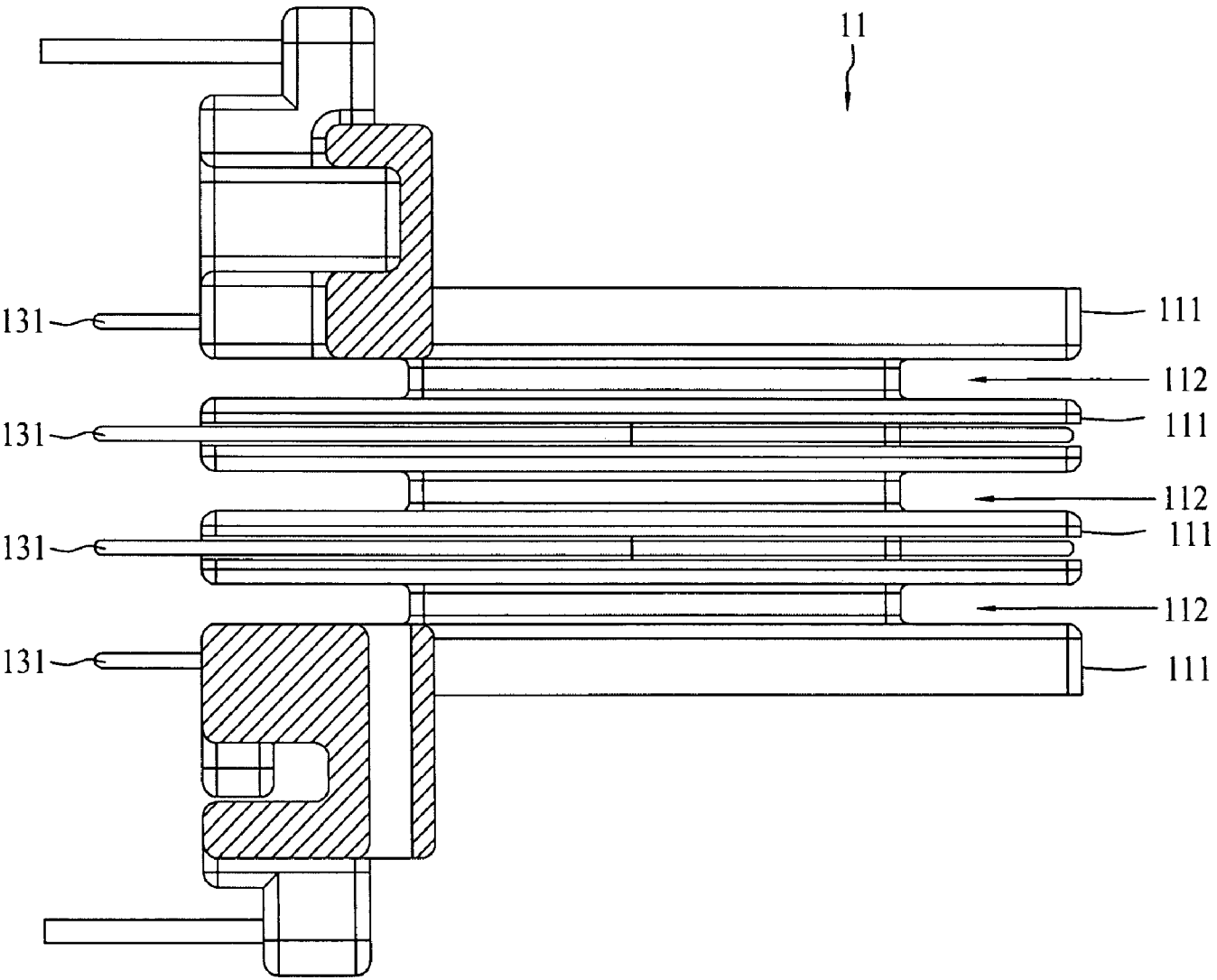
FIG. 2 is a top view of the coil frame of this invention.

FIGS. 1 and 2 show the schematic perspective view and the top view of the coil frame 11 of this invention. The coil frame 11 comprises a plurality of partitions 111, a plurality of first coil grooves 112 and a plurality of coil openings 114. Both sides of each of the first coil grooves 112 are partitioned by one of the partitions 111 to define a corresponding first coil groove 112. The coil openings 114 are formed on the partitions 111 and connect the first coil grooves 112. Each of the partitions 111 comprises two sidewalls that define a corresponding coil opening 114. The input coil 12 is wound in the first coil grooves 112 through the coil openings 114.

As shown in FIGS. 1 and 3, the transformer 1 of this invention further comprises a magnetic core 14. The coil frame 11 has a transverse through hole 119. At least one portion of the magnetic core 14 is received in the transverse through hole 119. When a current is introduced into the input coil 12, the magnetic core 14 is adapted to assist in inducing a current in the output coil 13 by strengthening the resulting magnetic field.

As shown in FIGS. 3 and 5, the input coil 12 is preferably electrically connected to the PCB via pins 16, 17, 18, 19 fixed to the coil frame 11. The current flows into the input coil 12 from the pin 17, through the pins 18, 19 connected in series and then flows out from the pin 16. However, the input coil 12 may also be electrically connected in series with the PCB via another number of pins or pins in other forms or at other locations.

In reference to both FIGS. 1 and 3, because the transformer 1 uses the metallic strip 131 as the output coil 13 to increase the output power, a coil wire 121 wrapped with three insulation layers must be used for the input coil 12 according to the safety regulations, which renders the coil wire 121 liable to cracking due to the increased thickness. In view of this, at least one of the sidewalls of each of the partition 111 is a tapered wall 117 with a chamfered angle A or a rounded wall 118 with a rounded angle R. The chamfered angle A of the tapered wall 117 is substantially less than 15 degrees, and preferably range from 5 to 10 degrees. The rounded angle R of the rounded wall 118 has a radius of substantially no less than 0.8 mm, and is preferred to be around 0.8 mm. Guided by the tapered wall 117 and the rounded wall 118, the coil wire 121 of the input coil 12 forms a bended angle that is substantially less than 15 degrees at the location where the input coil 12 passes each of the coil openings 114. With this arrangement, the cracking of the coil wire 121 wrapped with three insulation layers due to an overly large bended angle can be avoided.

The transformer 1 of this invention does not necessarily comprise four output coils 13, four partitions 111, three first coil grooves 112, four second coil grooves 113 and four coil openings 114 as shown in the figures. Rather, other numbers of output coils 13, partitions 111, first coil grooves 112, second coil grooves 113 and coil openings 114 at other locations or in other forms may also accomplish the goal of this invention, so no limitation is made thereto.

As described above, by using at least one metallic strip as the output coil, the transformer of this invention delivers a higher output power. In addition, because a metallic strip can be inserted directly into the PCB, the use of output pins is eliminated. Furthermore, in the transformer of this invention, by shaping the partitions of the coil frame as a tapered wall with a chamfered angle or a rounded wall with a rounded angle, a bended angle formed by the input coil at the location where the input coil passes each of the coil openings is substantially less than 15 degrees, thus preventing the coil wire from cracking due to the overly large bended angle.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A transformer, comprising:

a coil frame comprising a plurality of partitions, a plurality of first coil grooves and a plurality of coil openings, in which the partitions define the first coil grooves, and the coil openings are formed on the partitions and connect the first coil grooves;

an input coil disposed on the coil frame, passing the coil openings and wound in the first coil grooves; and an output coil disposed on the coil frame and interlaced with the input coil, in which the output coil comprises at least one metallic strip, and a second voltage outputted by the output coil is induced by a first voltage inputted into the input coil, wherein the coil opening of each of the partitions is defined by two side walls, at least one of the side walls is a tapered wall having a chamfered angle or a rounded wall having a rounded angle, and a bended angle formed by the input coil at the location where the input coil passes each of the coil openings is substantially less than 15 degrees.

2. The transformer as claimed in claim 1, wherein the at least one of the side walls is the tapered wall having the chamfered angle.

3. The transformer as claimed in claim 2, wherein the chamfered angle is substantially less than 15 degrees.

4. The transformer as claimed in claim 3, wherein the chamfered angle is substantially between 5 degrees and 10 degrees.

5. The transformer as claimed in claim 1, wherein the at least one of the side walls is the rounded wall having the rounded angle.

6. The transformer as claimed in claim 5, wherein the rounded angle has a radius being equal to or greater than 0.8 mm substantially.

7. The transformer as claimed in claim 6, wherein the radius of the rounded angle is equal to 0.8 mm substantially.

8. The transformer as claimed in claim 1, the at least one metallic strip of the output coil is at least one copper strip.

9. The transformer as claimed in claim 1, wherein the coil frame further comprises a second coil groove receiving at least one metallic strip of the output coil.

10. The transformer as claimed in claim 1, wherein the transformer comprises four output coils.

11. The transformer as claimed in claim 1, wherein the input coil comprises a wound wire covered with three insulating layers.

12. The transformer as claimed in claim 1, further comprising a magnetic core, wherein the coil frame has a transverse through hole, and at least one portion of the magnetic core is received in the transverse through hole.

* * * * *